US009918529B2

(12) United States Patent
Lau

(10) Patent No.: US 9,918,529 B2
(45) Date of Patent: Mar. 20, 2018

(54) JOINING MECHANISM FOR JEWELRY RING AND BAND SET

(71) Applicant: Simply Bliss, Inc., New York, NY (US)

(72) Inventor: Bliss Lau, New York, NY (US)

(73) Assignee: Simply Bliss, Inc., New York, NY (US)

( * ) Notice: Subject to any disclaimer, the term of this patent is extended or adjusted under 35 U.S.C. 154(b) by 274 days.

(21) Appl. No.: 14/863,351

(22) Filed: Sep. 23, 2015

(65) Prior Publication Data

US 2017/0079389 A1 Mar. 23, 2017

(51) Int. Cl.
*A44C 9/00* (2006.01)

(52) U.S. Cl.
CPC ..... *A44C 9/0023* (2013.01)

(58) Field of Classification Search
CPC ... A44C 9/0007; A44C 9/0015; A44C 9/0023; A44C 5/0084; A44C 5/0092
USPC ..... 63/15; 403/364, 381
See application file for complete search history.

(56) References Cited

U.S. PATENT DOCUMENTS 2,061,655 A * 11/1936 Granat ..... A44C 9/0023 63/15.1
2,262,513 A * 11/1941 Novack ..... A44C 9/0023 63/15.2
4,770,166 A * 9/1988 Garris ..... A61F 5/05875 602/22
4,932,396 A * 6/1990 Garris ..... A61F 5/05875 29/896.412
5,027,617 A * 7/1991 Bonchek ..... A44C 9/0023 63/15.1
5,114,265 A * 5/1992 Grisley ..... B27F 1/12 144/144.1
5,596,887 A * 1/1997 Bergagnini ..... A44C 9/0023 63/15.1
5,727,399 A * 3/1998 Bergagnini ..... A44C 9/0023 63/15.1
6,393,685 B1 * 5/2002 Collins ..... B81C 3/008 156/257
2010/0155370 A1 * 6/2010 Obergoenner ..... B65D 9/04 217/96
2012/0011888 A1 * 1/2012 Patterson ..... A44C 9/003 63/15

(Continued)

*Primary Examiner* — Jack W Lavinder
(74) *Attorney, Agent, or Firm* — Mauriel Kapouytian Woods LLP; Andrew A. Noble

(57) ABSTRACT

A jewelry joining mechanism is disclosed for coupling a main ring having a lower body portion and a neck portion, to a band including at least a first ring-shaped body and a second ring-shaped body. The mechanism comprises an integrally formed protruding notch extending along the lower body portion of the main ring, the notch having a greater maximum cross-sectional width than the main ring neck portion, and an integrally formed open-ended groove extending between the first and second ring-shaped bodies of the band, the groove being bounded in part by aligned and opposing flanges extending along at least a portion of a length of the groove, the flanges defining an open top end of the groove, wherein the groove is adapted to receive the notch such that, when the notch is fully disposed within the groove, the main ring and the band maintain a substantially fixed angular configuration.

18 Claims, 7 Drawing Sheets

(56) References Cited

U.S. PATENT DOCUMENTS

| | | | | |
|---|---|---|---|---|
| 2015/0320154 | A1* | 11/2015 | Nevatia | A44C 17/0208 63/15 |
| 2016/0270491 | A1* | 9/2016 | Spencer | A44C 5/185 |

* cited by examiner

JOINING MECHANISM FOR JEWELRY RING AND BAND SET

TECHNICAL FIELD

The present invention relates generally to jewelry production, and in particular to a joining mechanism for a jewelry ring and band.

BACKGROUND

The background description includes information that may be useful in understanding the present invention. It is not an admission that any of the information provided herein is prior art or relevant to the presently claimed invention, or that any publication specifically or implicitly referenced is prior art.

In jewelry design, it is often aesthetically desirable to employ configurations of multiple rings, bands, earrings, bangles, etc. In some cases, these configurations are intended to maintain certain fixed relationships between the jewelry elements for aesthetic reasons, and also to provide comfort to the wearer. Despite the considerable appeal such designs may have in theory, however, multiple element jewelry designs often do not achieve their intended design goals when implemented. For example, typical configurations often must employ stabilizing struts or other bracing mechanisms to keep jewelry elements together and in their aesthetically intended configuration when worn. Unfortunately, such solutions are often unsightly, and also may cause discomfort to the wearer.

SUMMARY

As such, there is still a need in jewelry design for a joining mechanism that can secure a combination of jewelry elements together in an aesthetically intended geometric configuration when worn, while also providing improved comfort to the wearer.

To that end, a joining mechanism for coupling a jewelry main ring, having a lower body portion and a neck portion, to a jewelry band including at least a first ring-shaped body and a second ring-shaped body is disclosed herein. In an embodiment, the joining mechanism comprises an integrally formed protruding notch extending along the lower body portion of the main ring, the notch having a greater maximum cross-sectional width than the neck portion of the main ring. The joining mechanism further comprises and an integrally formed open-ended groove extending between the first ring-shaped body and the second ring-shaped body of the band, the groove being bounded in part by aligned and opposing flanges extending along at least a portion of a length of the groove, the flanges defining an open top end of the groove, wherein the groove is adapted to receive the notch at an open longitudinal end of the groove such that, when the notch is fully disposed within the groove, the main ring and the band maintain a substantially fixed angular configuration relative to each other. The notch and the groove may have one of clover-shaped, T-shaped, diamond-shaped or rounded cross-sectional profiles, and at least one of the main ring and the band may include an ornamental setting. In some embodiments, the groove may include two open longitudinal ends.

In some embodiments, the notch and the groove may have base portions that are substantially flat.

In some embodiments, the notch and the groove may have base portions that are concave.

In some embodiments, the notch may be substantially equal in length to the groove.

In some embodiments, when the notch is fully disposed within the groove, end portions of the notch and the groove may form substantially flush surfaces.

In some embodiments, the flanges of the groove may extend along the full length of the groove.

In some embodiments, a main ring flange may be integrally formed along the lower body portion of the main ring such that the main ring flange is located substantially above the notch, wherein, when the notch is disposed within the groove, a bottom portion of the main ring flange is engaged with top portions of the flanges of the groove. The main ring flange may be substantially equal in length to the notch.

In some embodiments, the maximum cross-sectional width of the notch may be greater than a width of the open top end of the groove.

In some embodiments, the maximum cross-sectional width of the notch and a cross-sectional width of the neck portion of the main ring may be determined based on a predetermined ratio. The neck portion of the main ring may have a substantially uniform cross-sectional width.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

For purposes of illustration only, several aspects of particular embodiments of the invention are described by reference to the following figures.

While the invention is described with reference to the above drawings, the drawings are intended to be illustrative, and other embodiments are consistent with the spirit, and within the scope, of the invention.

DETAILED DESCRIPTION

The following description is presented to enable any person skilled in the art to make and use the invention, and is provided in the context of particular applications and their requirements. Various modifications to the exemplary embodiments will be readily apparent to those skilled in the art, and the generic principles defined herein may be applied to other embodiments and applications without departing from the spirit and scope of the invention. Thus, the invention is not intended to be limited to the embodiments shown, but is to be accorded the widest scope consistent with the principles and features disclosed herein.

Figure 1A:
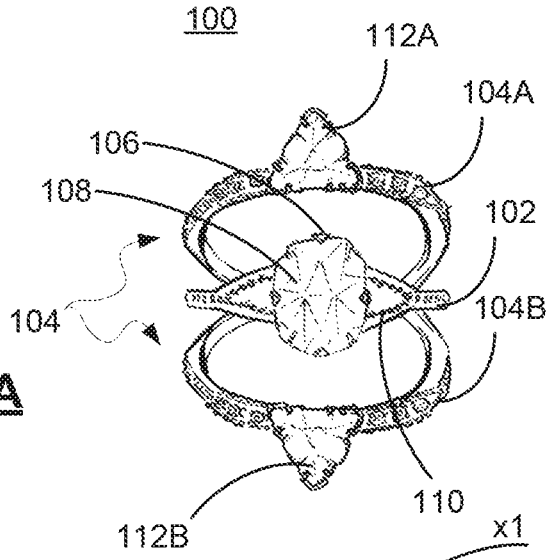
FIG. 1A illustrates a top-perspective view of a jewelry ring and band set in accordance with an embodiment.

FIG. 1A illustrates a top-perspective view of a jewelry ring and band set in accordance with an embodiment. Jewelry ring and band set 100 comprises a main ring 102 and a band 104. As illustrated in FIG. 1A, main ring 102 is an arcuate band configured to encircle a wearer's finger. Main ring 102 may include an ornamental mount 106. Ornamental mount 106 may comprise, for example, one or more clamps, stabilizing struts or other bracing mechanisms configured to secure one or more gem stones (e.g., one or more diamonds or other precious stones, semi-precious stones, etc.), such as gem stone 108, to main ring 102. FIG. 1A further illustrates a head portion 110 of main ring 102 that also may be configured, e.g., in conjunction with ornamental mount 106, to secure gem stone 108 to main ring 102. For example, head portion 110 also may include one or more struts or bracing mechanisms (as shown), or otherwise have a relatively wide cross-sectional width in order to stabilize gem stone 108 depending, for example, on the size or weight of gem stone 108.

FIG. 1A further illustrates band 104. Band 104 comprises at least a first ring-shaped (arcuate) body 104A and a second ring-shaped (arcuate) body 104B, integrally formed with each other, and each configured to encircle a wearer's finger. In some embodiments, one or more of first ring-shaped body 104A and second ring-shaped body 104B may include an ornamental mount, such as ornamental mounts 112A and 112B. Ornamental mounts 112A and 112B also may comprise, for example, one or more clamps, stabilizing struts or other bracing mechanisms configured to secure one or more gem stones to first ring-shaped body 104A and second ring-shaped body 104B, respectively.

Various materials may be used for the illustrated components of ring and band set 100. However, in preferred embodiments, both main ring 102 and the band 104 are made of one or more metals such as, for example, silver, white gold, yellow gold, rose gold (copper), platinum, titanium, brass or stainless steel. In some embodiments, both main ring 102 and band 104 are made of one and the same material, however, in other embodiments, main ring 102 and band 104 may be made of different materials, e.g., to achieve various aesthetic effects.

Figure 1B:
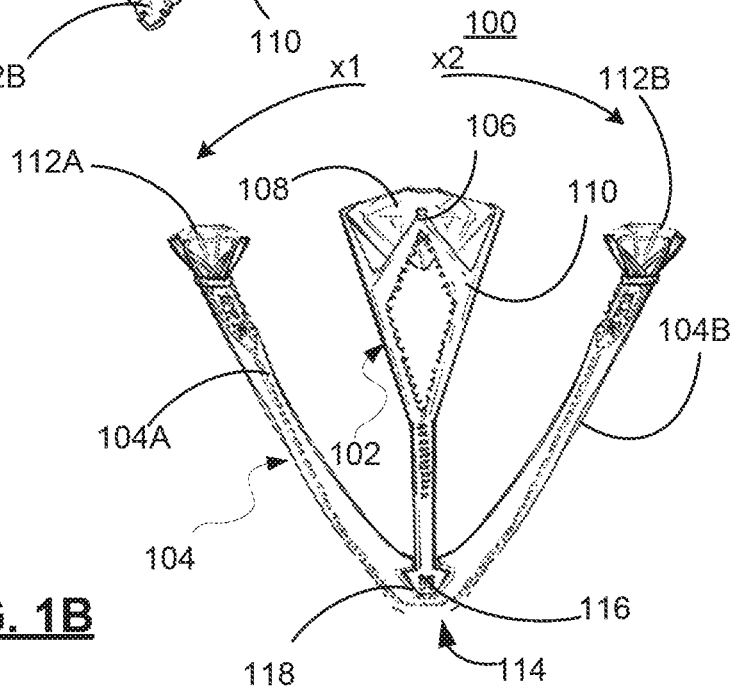
FIG. 1B illustrates a side view of a jewelry ring and band set in accordance with an embodiment.

FIG. 1B illustrates a side view of a jewelry ring and band set in accordance with an embodiment. FIG. 1B further illustrates jewelry ring and band set 100 comprising main ring 102 and band 104. As illustrated, jewelry ring and band set 100 further comprises joining mechanism 114.

As described in further detail below, joining mechanism 114 comprises an integrally formed protruding notch 116 extending along a lower body portion of main ring 102, and an integrally formed open-ended groove 118 extending between first ring-shaped body 104A and second ring-shaped body 104B of band 104. In an embodiment, joining mechanism 114 is configured to maintain main ring 102 and band 104 in a substantially fixed angular configuration relative to each other. For example, joining mechanism 114 prevents substantial angular movement of main ring 102 in directions x1 and x2 relative to band 104. As such, a combination of jewelry elements can be secured together in an aesthetically intended angular configuration when worn. Further, joining mechanism 114 may also provide improved comfort to the wearer.

Figure 2A:
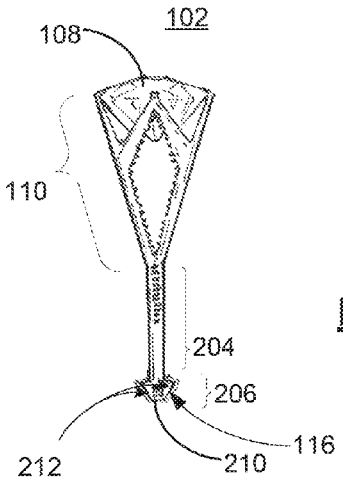
FIG. 2A illustrates a side view of a jewelry main ring in accordance with an embodiment.

FIG. 2A illustrates a side view of a jewelry main ring in accordance with an embodiment. In FIG. 2A, main ring 200 comprises head portion 110 including an ornamental mount and gemstone 203; neck portion 204 abutting head portion 110 and having a generally narrower cross-sectional width than head portion 110; and lower body portion 206, abutting neck portion 204, and including integrally formed protruding notch 116.

The side view of FIG. 2A illustrates a cross-sectional view of integrally formed protruding notch 116. In FIG. 2A, notch 116 includes a substantially flat bottom portion 210 and symmetrical sidewall portions 212 having a generally diamond-shaped cross-sectional profile. While the notch illustrated in FIG. 2A is exemplary, notch 116 may be configured to have various other exemplary cross-sectional profiles, as further described below.

In an embodiment, notch 116 has a greater maximum cross-sectional width than neck portion 204. For example, the maximum cross-sectional width of notch 116 and the cross-sectional width of the neck portion 204 may be determined based on a predetermined ratio. In some embodiments, neck portion 204 may have a substantially uniform cross-sectional profile and width, as shown. In various other embodiments, however, neck portion 204 may have a non-uniform cross sectional profile (e.g., a tapered or wave-pattern) of variable width. For example, neck portion 204 may be configured to provide comfort to an intended wearer, satisfy aesthetic criteria, or both. As such, a cross-sectional width of neck portion 204 may be selected based on various comfort-related considerations (e.g., based on an intended wearer's finger size) and/or aesthetic considerations (e.g., to aesthetically enhance ornamental mount 203). As such, while the proportions of neck portion 204 and notch 116 shown in FIG. 2A are exemplary, other configurations are possible. In each case, however, the maximum cross-sectional width of notch 116 (e.g., the maximum cross-sectional width between sidewalls 212) is greater than the maximum cross-sectional width of neck portion 204.

Figure 2B:
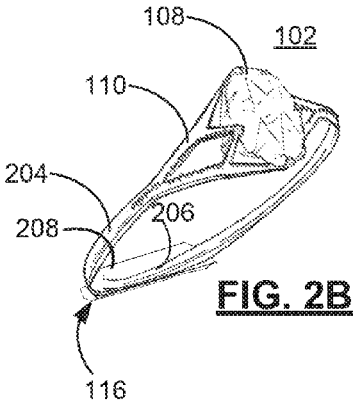
FIG. 2B illustrates a perspective view of a jewelry main ring in accordance with an embodiment.

FIG. 2B illustrates a perspective view of a jewelry main ring in accordance with an embodiment. FIG. 2B again illustrates main ring 200 comprising head portion 110 including an ornamental mount and gemstone 203, neck portion 204, and lower body portion 206 including integrally formed protruding notch 116.

FIG. 2B further illustrates lower body portion 206 defining a substantially flat base portion of main ring 200. In some embodiments, the inner surface area of lower body portion 206 may include a generally rounded area extending along at least a portion of a length of lower body portion 206, such as to provide increased comfort to a wearer.

FIG. 2B further illustrates notch 116 extending along lower body portion 206. In an embodiment, notch 116 extends along at least a portion of a length of lower body portion 206. In various exemplary embodiments, notch 116 may extend along the full length of lower body portion 206, as shown.

In some embodiments, main ring 200 may further comprise a main ring flange 208 that may be integrally formed along lower body portion 206 such that the main ring flange 208 is located substantially above notch 116. In some embodiments, a main ring flange 208 may provide additional surface area to lower body portion for notch 116 to be integrally formed, such as when it is determined to be aesthetically desirable to have a thinner cross-section neck portion 204 and/or lower body portion 206. In some embodiments, the main ring flange 208 may be substantially equal in length to notch 116.

Figure 3A:
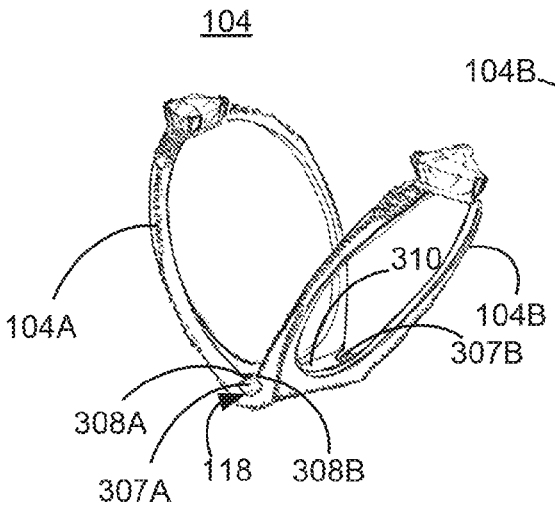
FIG. 3A illustrates a perspective view of a band in accordance with an embodiment.

FIG. 3A illustrates a perspective view of a band in accordance with an embodiment. In FIG. 3A, band 300 includes first ring-shaped body 104A, second ring-shaped body 104B and integrally formed open-ended groove 118. FIG. 3A illustrates that groove 118 extends between first ring-shaped body 104A and second ring-shaped body 104B. FIG. 3A further illustrates that groove 118 includes at least one open longitudinal end 307A. In some embodiments, groove 118 may include two open longitudinal ends 307A and 307B. FIG. 3A further illustrates that groove 118 may have a generally diamond-shaped cross-sectional profile including peaked sidewalls and a substantially flat bottom portion. While the groove illustrated in FIG. 3A is exemplary, groove 118 may be configured to have various other exemplary cross-sectional profiles, e.g., a cross-sectional profile that is adapted to receive a notch (e.g., notch 116) having a matching cross-sectional profile, as further described below.

FIG. 3A further illustrates that groove 118 is bounded in part by aligned and opposing flanges 308A and 308B extending along at least a portion of a length of groove 118, such that the flanges 308A and 308B define an open top end 310 of groove 118. In some embodiments, flanges 308A and 308B may extend along the full length of groove 118. As such, the at least one open longitudinal end (e.g., longitudinal end 307A and/or 307B) and the open top end 310 of groove 118 may be adapted to receive a notch having a matching cross-sectional profile.

Figure 3B:
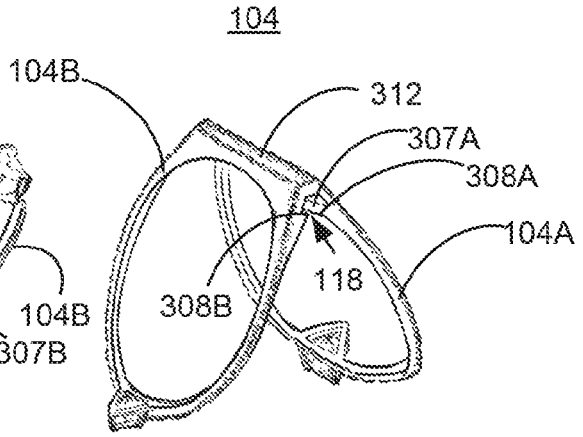
FIG. 3B illustrates another perspective view of a band in accordance with an embodiment.

FIG. 3B illustrates another perspective view of a band in accordance with an embodiment. In FIG. 3B, band 300 again includes first ring-shaped body 104A, second ring-shaped body 104B and integrally formed open-ended groove 118 extending between first ring-shaped body 104A and second ring-shaped body 104B. FIG. 3B further illustrates that groove 118 includes at least one open longitudinal end 307A, and is bounded in part by aligned and opposing flanges 308A and 308B extending along at least a portion of a length of groove 118, such that the flanges 308A and 308B define an open top end 310 of groove 118. FIG. 3B further illustrates that, in at least some embodiments, band 300 may comprise a substantially flat base portion 312, as shown. However, in alternative embodiments, band 300 may comprise a rounded base portion 312, e.g., either for reasons of aesthetics or comfort.

Figure 4A:
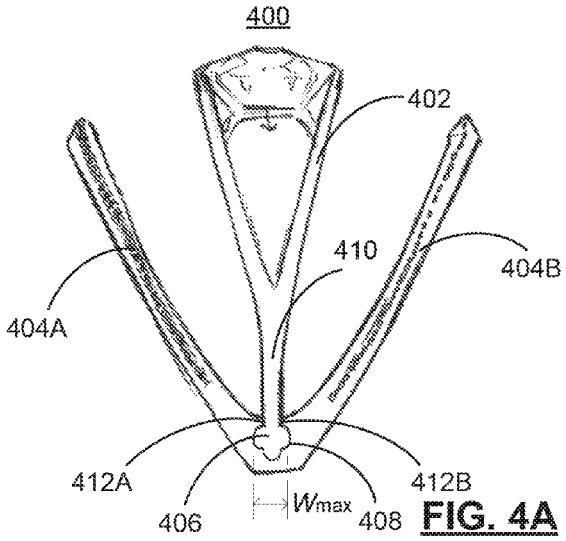
FIG. 4A illustrates a side view of a clover-shaped cross-sectional profile joining mechanism in accordance with an embodiment.
Figure 4B:
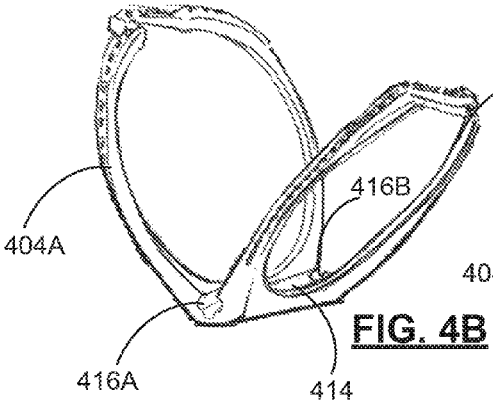
FIG. 4B illustrates a perspective view of a clover-shaped cross-sectional profile joining mechanism in accordance with an embodiment.
Figure 4C:
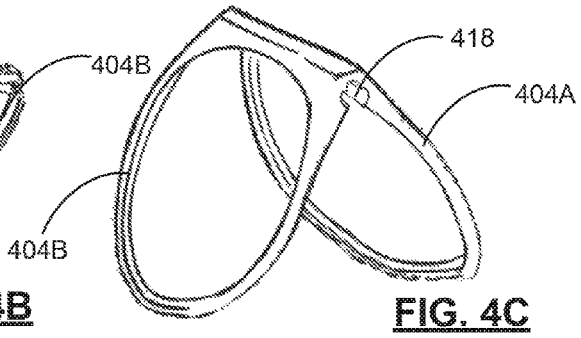
FIG. 4C illustrates another perspective view of a clover-shaped cross-sectional profile joining mechanism in accordance with an embodiment.

In FIGS. 4A-4C, a clover-shaped cross-sectional profile joining mechanism for coupling a jewelry main ring, having a lower body portion and a neck portion, to a jewelry band including at least a first ring-shaped body and a second ring-shaped body is shown. FIG. 4A illustrates a side view of a clover-shaped cross-sectional profile joining mechanism in accordance with an embodiment. In FIG. 4A, jewelry ring and band set 400 comprises a clover-shaped cross-sectional profile joining mechanism for coupling main ring 402 and band 404.

The clover-shaped cross-sectional profile joining mechanism comprises an integrally formed protruding notch 406 having rounded sidewalls and a concave base portion. Notch 406 extends along a lower body portion of main ring 402. In an embodiment, FIG. 4A illustrates that clover-shaped cross-sectional profile notch 406 has a greater maximum cross-sectional width, $W_{max}$, than neck portion 410 of main ring 402. In some embodiments, the maximum cross-sectional width of notch 406, $W_{max}$, and a cross-sectional width of neck portion 410 of main ring 402 may be determined based on a predetermined ratio, e.g., in embodiments where neck portion 410 has a substantially uniform cross-sectional width, such as shown.

The clover-shaped cross-sectional profile joining mechanism further comprises an integrally formed open-ended groove 408, which also has a clover-shaped cross-sectional profile, extending between first ring-shaped body 404A and second ring-shaped body 404B of band 404. FIG. 4A further illustrates that clover-shaped cross-sectional profile groove 408 is bounded in part by aligned and opposing flanges 412A and 412B extending along at least a portion of a length of groove 408, such that flanges 412A and 412B define an open top end 414 of groove 408, as shown in FIG. 4B. The maximum cross-sectional width of notch 406, $W_{max}$, may be greater than a width of the open top end 414 of groove 408. Further, in some embodiments flanges 412A and 412B may extend along the full length of the groove 408. As such, groove 408 is adapted to receive notch 406 at an open longitudinal end of groove 408 such that, when notch 406 is fully disposed within groove 408, main ring 402 and band 404 maintain a substantially fixed angular configuration relative to each other.

In some embodiments, main ring 402 may further comprise a main ring flange (not shown) that may be integrally formed along its lower body portion such that the main ring flange is located substantially above notch 406. In some embodiments, the main ring flange may be substantially equal in length to notch 406 such that, when notch 406 is disposed within groove 408, a bottom portion of the main ring flange is engaged with top portions of flanges 412A and 412B. Therefore, the main ring flange may provide additional angular stability for main ring 402 relative to band 404.

In some embodiments, notch 406 may be substantially equal in length to groove 408. For example, when notch 406 is fully disposed within groove 408, the clover-shaped cross-sectional profile end portions of notch 406 and clover-shaped cross-sectional profile end portions of groove 408, such as open longitudinal end portions 416A and 416B shown in FIG. 4B, may form substantially flush surfaces (e.g., for reasons of aesthetics or comfort to the wearer). Alternatively, groove 408 may include only one open longitudinal end, such as open longitudinal end 418 shown in FIG. 4C, such that, when notch 406 is fully disposed within groove 408, an end portion of notch 406 and the open longitudinal end of groove 408, e.g., open longitudinal end 418, may form a substantially flush surface.

Figure 5A:
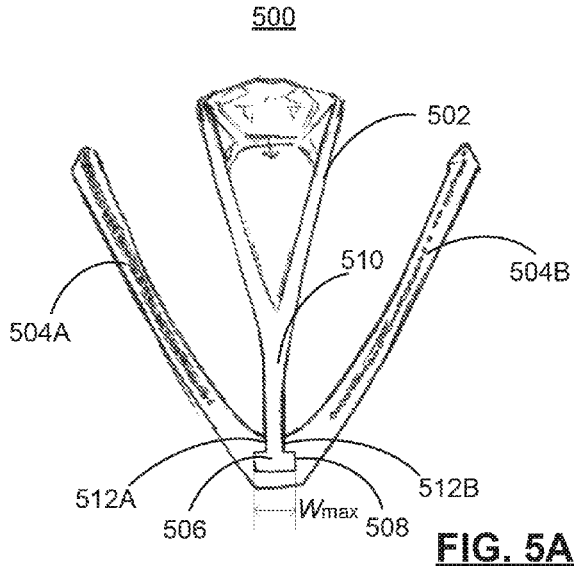
FIG. 5A illustrates a side view of a T-shaped cross-sectional profile joining mechanism in accordance with an embodiment.
Figure 5B:
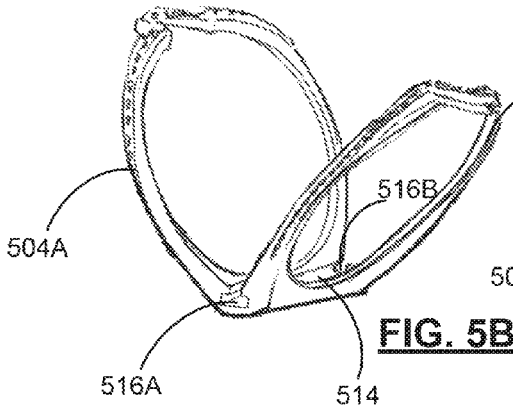
FIG. 5B illustrates a perspective view of a T-shaped cross-sectional profile joining mechanism in accordance with an embodiment.
Figure 5C:
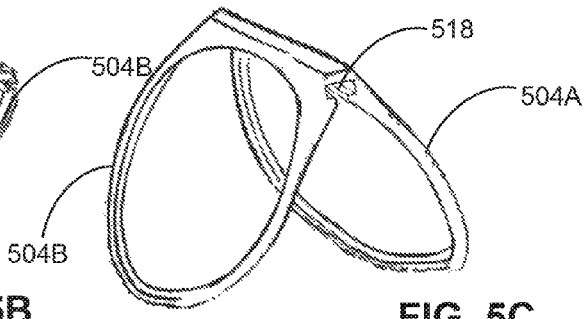
FIG. 5C illustrates another perspective view of a T-shaped cross-sectional profile joining mechanism in accordance with an embodiment.

In FIGS. 5A-5C, a T-shaped cross-sectional profile joining mechanism for coupling a jewelry main ring, having a lower body portion and a neck portion, to a jewelry band including at least a first ring-shaped body and a second ring-shaped body is shown. FIG. 5A illustrates a side view of a T-shaped cross-sectional profile joining mechanism in accordance with an embodiment. In FIG. 5A, jewelry ring and band set 500 comprises a T-shaped cross-sectional profile joining mechanism for coupling main ring 502 and band 504.

The T-shaped cross-sectional profile joining mechanism comprises an integrally formed protruding notch 506 having substantially flat sidewalls and a substantially flat base portion. Notch 506 extends along a lower body portion of main ring 502. In an embodiment, FIG. 5A illustrates that T-shaped cross-sectional profile notch 506 has a greater maximum cross-sectional width, $W_{max}$, than neck portion 510 of the main ring 502. In some embodiments, the maximum cross-sectional width of notch 506, $W_{max}$, and a cross-sectional width of the neck portion 510 of the main ring may be determined based on a predetermined ratio, e.g., in embodiments where neck portion 510 has a substantially uniform cross-sectional width, such as shown.

The T-shaped cross-sectional profile joining mechanism further comprises an integrally formed open-ended groove 508, which also has a T-shaped cross-sectional profile, extending between first ring-shaped body 504A and second ring-shaped body 504B of band 504. FIG. 5A further illustrates that T-shaped cross-sectional profile groove 508 is bounded in part by aligned and opposing flanges 512A and 512B extending along at least a portion of a length of groove 508, such that flanges 512A and 512B define an open top end 514 of groove 508, as shown in FIG. 5B. The maximum cross-sectional width of notch 506, $W_{max}$, may be greater than a width of the open top end 514 of groove 508. Further, in some embodiments flanges 512A and 512B may extend along the full length of the groove 508. As such, groove 508 is adapted to receive notch 506 at an open longitudinal end of groove 508 such that, when notch 506 is fully disposed within groove 508, main ring 502 and band 504 maintain a substantially fixed angular configuration relative to each other.

In some embodiments, main ring 502 may further comprise a main ring flange (not shown) that may be integrally formed along its lower body portion such that the main ring flange is located substantially above notch 506. In some embodiments, the main ring flange may be substantially equal in length to notch 506 such that, when notch 506 is disposed within groove 508, a bottom portion of the main ring flange is engaged with top portions of flanges 512A and 512B. Therefore, the main ring flange may provide additional angular stability for main ring 502 relative to band 504.

In some embodiments, notch 506 may be substantially equal in length to groove 508. For example, when notch 506 is fully disposed within groove 508, the T-shaped cross-sectional profile end portions of notch 506 and T-shaped cross-sectional profile end portions of groove 508, such as open longitudinal end portions 516A and 516B shown in FIG. 5B, may form substantially flush surfaces (e.g., for reasons of aesthetics or comfort to the wearer). Alternatively, groove 508 may include only one open longitudinal end, such as open longitudinal end 518 shown in FIG. 5C, such that, when notch 506 is fully disposed within groove 508, an end portion of notch 506 and the open longitudinal end of groove 508, e.g., open longitudinal end 518, may form a substantially flush surface.

Figure 6A:
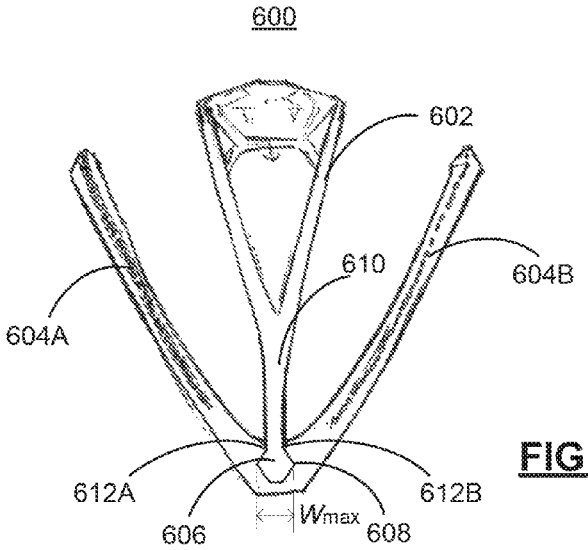
FIG. 6A illustrates a side view of a diamond-shaped cross-sectional profile joining mechanism in accordance with an embodiment.
Figure 6B:
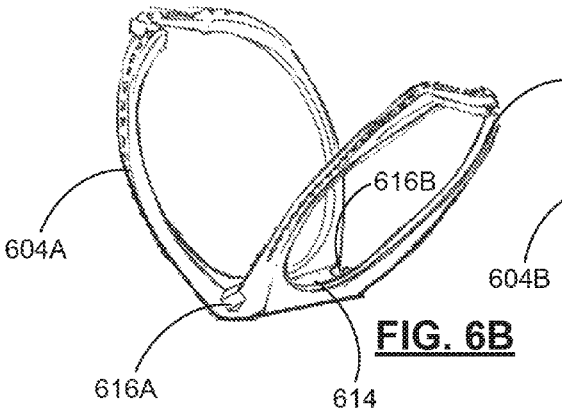
FIG. 6B illustrates a perspective view of a diamond-shaped cross-sectional profile joining mechanism in accordance with an embodiment.
Figure 6C:
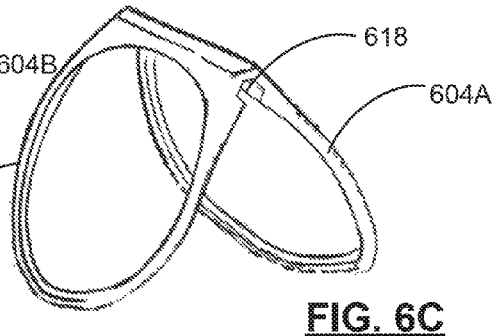
FIG. 6C illustrates another perspective view of a diamond-shaped cross-sectional profile joining mechanism in accordance with an embodiment.

In FIGS. 6A-6C, a diamond-shaped cross-sectional profile joining mechanism for coupling a jewelry main ring, having a lower body portion and a neck portion, to a jewelry band including at least a first ring-shaped body and a second ring-shaped body is shown. FIG. 6A illustrates a side view of a diamond-shaped cross-sectional profile joining mechanism in accordance with an embodiment. In FIG. 6A, jewelry ring and band set 600 comprises a diamond-shaped cross-sectional profile joining mechanism for coupling main ring 602 and band 604.

The diamond-shaped cross-sectional profile joining mechanism comprises an integrally formed protruding notch 606 having substantially peaked sidewalls and a substantially flat base portion. Notch 606 extends along a lower body portion of main ring 602. In an embodiment, FIG. 6A illustrates that diamond-shaped cross-sectional profile notch 606 has a greater maximum cross-sectional width, $W_{max}$, than neck portion 610 of main ring 602. In some embodiments, the maximum cross-sectional width of notch 606, $W_{max}$, and a cross-sectional width of neck portion 610 of main ring 602 may be determined based on a predetermined ratio, e.g., in embodiments where neck portion 610 has a substantially uniform cross-sectional width, such as shown. Referring back to FIG. 2A, FIG. 2A illustrates an alternative diamond-shaped cross-sectional profile joining mechanism that comprises an integrally formed protruding notch 116 having peaked sidewalls 212 that widen in the direction of neck portion 204 and a substantially flat base portion. One skilled in the art will readily appreciate that other diamond-shaped cross-sectional profiles are possible.

The diamond-shaped cross-sectional profile joining mechanism further comprises an integrally formed open-ended groove 608, which also has a diamond-shaped cross-sectional profile, extending between first ring-shaped body 604A and second ring-shaped body 604B of band 604. FIG. 6A further illustrates that diamond-shaped cross-sectional profile groove 608 is bounded in part by aligned and opposing flanges 612A and 612B extending along at least a portion of a length of groove 608, such that flanges 612A and 612B define an open top end 614 of groove 608, as shown in FIG. 6B. The maximum cross-sectional width of notch 606, $W_{max}$, may be greater than a width of the open top end 614 of groove 608. Further, in some embodiments flanges 612A and 612B may extend along the full length of the groove 608. As such, groove 608 is adapted to receive notch 606 at an open longitudinal end of groove 608 such that, when notch 606 is fully disposed within groove 608, main ring 602 and band 604 maintain a substantially fixed angular configuration relative to each other. Referring back to FIGS. 3A and 3B, FIGS. 3A and 3B illustrate an alternative diamond-shaped cross-sectional profile joining mechanism that comprises an integrally formed integrally formed open-ended groove 118, which has a diamond-shaped cross-sectional profile that includes peaked sidewalls that widen in the direction of flanges 308A and 308B, and a substantially flat base portion.

In some embodiments, main ring 602 may further comprise a main ring flange (not shown) that may be integrally formed along its lower body portion such that the main ring flange is located substantially above notch 606. In some embodiments, the main ring flange may be substantially equal in length to notch 606 such that, when notch 606 is disposed within groove 608, a bottom portion of the main ring flange is engaged with top portions of flanges 612A and 612B. Therefore, the main ring flange may provide additional angular stability for main ring 602 relative to band 604.

In some embodiments, notch 606 may be substantially equal in length to groove 608. For example, when notch 606 is fully disposed within groove 608, the diamond-shaped cross-sectional profile end portions of notch 606 and diamond-shaped cross-sectional profile end portions of groove 608, such as open longitudinal end portions 616A and 616B shown in FIG. 6B, may form substantially flush surfaces (e.g., for reasons of aesthetics or comfort to the wearer). Alternatively, groove 608 may include only one open longitudinal end, such as open longitudinal end 618 shown in FIG. 6C, such that, when notch 606 is fully disposed within groove 608, an end portion of notch 606 and the open longitudinal end of groove 608, e.g., open longitudinal end 618, may form a substantially flush surface.

Figure 7A:
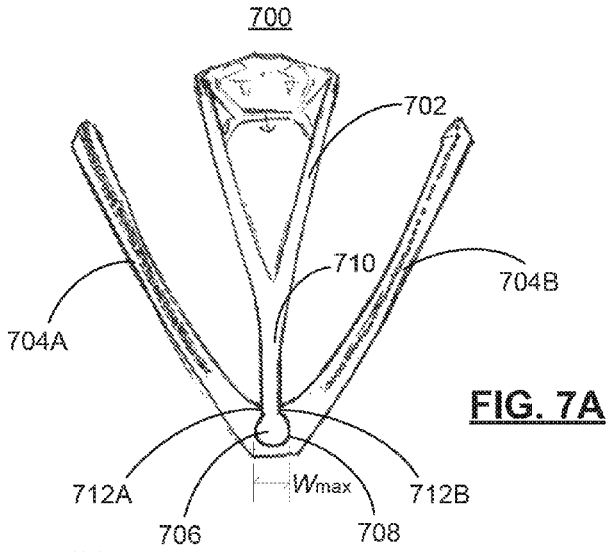
FIG. 7A illustrates a side view of a rounded cross-sectional profile joining mechanism in accordance with an embodiment.
Figure 7B:
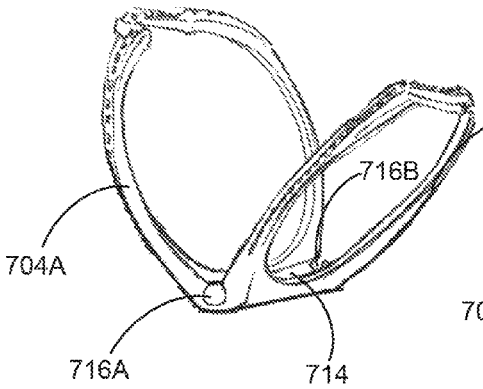
FIG. 7B illustrates a perspective view of a rounded cross-sectional profile joining mechanism in accordance with an embodiment.
Figure 7C:
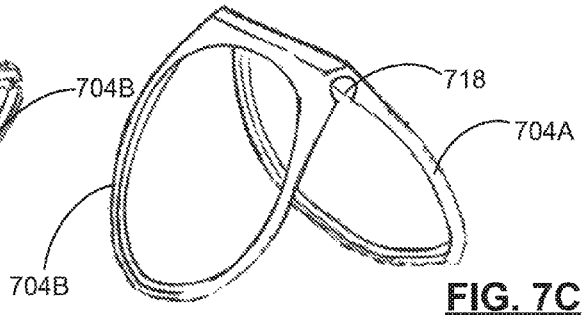
FIG. 7C illustrates another perspective view of a rounded cross-sectional profile joining mechanism in accordance with an embodiment.

In FIGS. 7A-7C, a rounded cross-sectional profile joining mechanism for coupling a jewelry main ring, having a lower body portion and a neck portion, to a jewelry band including at least a first ring-shaped body and a second ring-shaped body is shown. FIG. 7A illustrates a side view of a rounded cross-sectional profile joining mechanism in accordance with an embodiment. In FIG. 7A, jewelry ring and band set 700 comprises a rounded cross-sectional profile joining mechanism for coupling main ring 702 and band 704.

The rounded cross-sectional profile joining mechanism comprises an integrally formed, protruding and substantially round notch 706. Notch 706 extends along a lower body portion of main ring 702. In an embodiment, FIG. 7A illustrates that rounded cross-sectional profile notch 706 has a greater maximum cross-sectional width (or cross-sectional diameter), $W_{max}$, than neck portion 710 of main ring 702. In some embodiments, the maximum cross-sectional width of notch 706, $W_{max}$, and a cross-sectional width of neck portion 710 of main ring 702 may be determined based on a predetermined ratio, e.g., in embodiments where neck portion 710 has a substantially uniform cross-sectional width, such as shown.

The rounded cross-sectional profile joining mechanism further comprises an integrally formed open-ended groove 708, which also has a rounded cross-sectional profile, extending between first ring-shaped body 704A and second ring-shaped body 704B of band 704. FIG. 7A further illustrates that rounded cross-sectional profile groove 708 is bounded in part by aligned and opposing flanges 712A and 712B extending along at least a portion of a length of groove 708, such that flanges 712A and 712B define an open top end 714 of groove 708, as shown in FIG. 7B. The maximum cross-sectional width of notch 706, $W_{max}$, may be greater than a width of the open top end 714 of groove 708. Further, in some embodiments flanges 712A and 712B may extend along the full length of groove 708. As such, groove 708 is adapted to receive notch 706 at an open longitudinal end of groove 708 such that, when notch 706 is fully disposed within groove 708, main ring 702 and band 704 maintain a substantially fixed angular configuration relative to each other.

In some embodiments, main ring 702 may further comprise a main ring flange (not shown) that may be integrally formed along its lower body portion such that the main ring flange is located substantially above notch 706. In some embodiments, the main ring flange may be substantially equal in length to notch 706 such that, when notch 706 is disposed within groove 708, a bottom portion of the main ring flange is engaged with top portions of flanges 712A and 712B. Therefore, the main ring flange may provide additional angular stability for main ring 702 relative to band 704.

In some embodiments, notch 706 may be substantially equal in length to groove 708. For example, when notch 706 is fully disposed within groove 708, the rounded cross-sectional profile end portions of notch 706 and rounded cross-sectional profile end portions of groove 708, such as open longitudinal end portions 716A and 716B shown in FIG. 7B, may form substantially flush surfaces (e.g., for reasons of aesthetics or comfort to the wearer). Alternatively, groove 708 may include only one open longitudinal end, such as open longitudinal end 718 shown in FIG. 7C, such that, when notch 706 is fully disposed within groove 708, an end portion of notch 706 and the open longitudinal end of groove 708, e.g., open longitudinal end 718, may form a substantially flush surface.

While the invention has been particularly described with respect to the illustrated embodiments, it will be appreciated that various alterations, modifications and adaptations may be made based on the present disclosure, and are intended to be within the scope of the invention. While the invention has been described in connection with what are presently considered to be the most practical and preferred embodiments, it is to be understood that the invention is not limited to the disclosed embodiments but only by the following claims.

What is claimed is:

1. A joining mechanism for coupling a jewelry main ring, having a lower body portion and a neck portion, to a jewelry band including at least a first ring-shaped body and a second ring-shaped body, the joining mechanism comprising:

an integrally formed protruding notch extending along the lower body portion of the main ring, the notch having a greater maximum cross-sectional width than the neck portion of the main ring; and an integrally formed open-ended groove extending between the first ring-shaped body and the second ring-shaped body of the band, the groove being bounded in part by aligned and opposing flanges extending along at least a portion of a length of the groove, the flanges defining an open top end of the groove, wherein the groove is adapted to receive the notch at an open longitudinal end of the groove such that, when the notch is fully disposed within the groove, the main ring and the band maintain a substantially fixed angular configuration relative to each other.

2. The joining mechanism of claim 1, wherein the notch and the groove have clover-shaped cross-sectional profiles.

3. The joining mechanism of claim 1, wherein the notch and the groove have T-shaped cross-sectional profiles.

4. The joining mechanism of claim 1, wherein the notch and the groove have diamond-shaped cross-sectional profiles.

5. The joining mechanism of claim 1, wherein the notch and the groove have rounded cross-sectional profiles.

6. The joining mechanism of claim 1, wherein the notch and the groove have base portions that are substantially flat.

7. The joining mechanism of claim 1, wherein the notch and the groove have base portions that are concave.

8. The joining mechanism of claim 1, wherein the notch is substantially equal in length to the groove.

9. The joining mechanism of claim 8, wherein, when the notch is fully disposed within the groove, end portions of the notch and the groove form substantially flush surfaces.

10. The joining mechanism of claim 1, wherein the flanges of the groove extend along the full length of the groove.

11. The joining mechanism of claim 1, further comprising a main ring flange integrally formed along the lower body portion of the main ring such that the main ring flange is located substantially above the notch, wherein, when the notch is disposed within the groove, a bottom portion of the main ring flange is engaged with top portions of the flanges of the groove.

12. The joining mechanism of claim 11, wherein the main ring flange is substantially equal in length to the notch.

13. The joining mechanism of claim 1, wherein the maximum cross-sectional width of the notch is greater than a width of the open top end of the groove.

14. The joining mechanism of claim 1, wherein the maximum cross-sectional width of the notch and a cross-sectional width of the neck portion of the main ring are determined based on a predetermined ratio.

15. The joining mechanism of claim 1, wherein the neck portion of the main ring has a substantially uniform cross-sectional width.

16. The joining mechanism of claim 1, wherein the groove includes two open longitudinal ends.

17. The joining mechanism of claim 1, wherein at least one of the main ring and the band include an ornamental setting.

18. A jewelry ring and band set comprising:

a main ring having a lower body portion and a neck portion;

a band including at least a first ring-shaped body and a second ring-shaped body; and a joining mechanism comprising:

an integrally formed protruding notch extending along the lower body portion of the main ring, the notch having a greater maximum cross-sectional width than the neck portion of the main ring; and an integrally formed open-ended groove extending between the first ring-shaped body and the second ring-shaped body of the band, the groove being bounded in part by aligned and opposing flanges extending along at least a portion of a length of the groove, the flanges defining an open top end of the groove, wherein the groove is adapted to receive the notch at an open longitudinal end of the groove such that, when the notch is fully disposed within the groove, the main ring and the band maintain a substantially fixed angular configuration relative to each other.

* * * * *